US006773339B2

(12) United States Patent
Cooper et al.

(10) Patent No.: US 6,773,339 B2
(45) Date of Patent: Aug. 10, 2004

(54) ABRASIVE PAD, AND METHOD OF MAKING THE SAME

(75) Inventors: Alex Cooper, Brooklyn, NY (US); Yevgeny Bederak, Long Meadow, MA (US); Sergey Vladimirtsev, Brooklyn, NY (US); Victor Liotta, Huntington Station, NY (US)

(73) Assignee: Universal Photonics, Inc., Hicksville, NY (US)

( * ) Notice: Subject to any disclaimer, the term of this patent is extended or adjusted under 35 U.S.C. 154(b) by 0 days.

(21) Appl. No.: 10/314,974

(22) Filed: Dec. 10, 2002

(65) Prior Publication Data

US 2004/0121713 A1 Jun. 24, 2004

(51) Int. Cl.[7] ..... B24D 17/00
(52) U.S. Cl. ..... 451/495; 451/533; 451/359
(58) Field of Search ..... 451/495, 528, 451/533, 538, 539, 359, 548, 526

(56) References Cited

U.S. PATENT DOCUMENTS 1,779,682 A * 10/1930 Stratford
2,229,745 A * 1/1941 Kneisley
3,849,941 A * 11/1974 Barnes
3,875,703 A * 4/1975 Clements

* cited by examiner

*Primary Examiner*—Eileen P. Morgan
(74) *Attorney, Agent, or Firm*—I. Zborovsky

(57) ABSTRACT

An abrasive tool for abrasive treatment of curved surfaces, has a base; abrasive elements arranged on the base; and a connecting layer connecting the abrasive elements to the base, the connecting element being composed of an elastic material selected so that when a central area of the abrasive tool is displaced to impart to the abrasive tool a curved shape in correspondence with a curved shape of the object to be abrasively treated, a central area of the connecting layer stretches and the abrasive elements do not peel off from the base.

3 Claims, 8 Drawing Sheets

1. WORKING LAYER.
2. SUBLAYER.
3. BODY.

ABRASIVE PAD, AND METHOD OF MAKING THE SAME

BACKGROUND OF THE INVENTION

The present invention relates to abrasive tools, in particular abrasive pads for abrasive treatment of surfaces, in particular curved surfaces for example glass TV panels, and the like, and also to a method of producing the same.

Abrasive tools of the above general type are known in the art. The known tool includes a base, abrasive elements arranged on the base, and a connecting layer which connects the abrasive elements area to the base. The abrasive elements can be composed for example of felt, polyurethane, etc. The connecting layers are formed as an adhesive layer which adhesively attaches the abrasive elements to the base. Such an abrasive pad has a disadvantage. When the abrasive pad is mounted in the mandrel and pulled in the central region to curve it along a curved holder, the abrasive elements in the central region frequently peel off from the base.

SUMMARY OF THE INVENTION

Accordingly it is the present invention to provide an abrasive tool of the above mentioned general type, and a method of producing the same which avoids the disadvantages of the prior art.

In keeping with these objects and with others which will become apparent hereinafter, one feature of the present invention resides, briefly stated, in an abrasive tool which has a base; a plurality of abrasive elements arranged on said base; and a connecting layer for connection said abrasive elements to said base, said connecting of layer being composed of an elastic polymeric material which is stretchable so that when a central area of the pad is displaced to impart to the abrasive tool a curved shape corresponding to a curved shape of a holder, the elastic material of the connecting layer stretches to avoid peeling off of the abrasive elements in the central area of the tool.

A method of the invention includes the steps of producing an abrasive tool for abrasive treatment of curved surfaces, comprising providing a base; a plurality of abrasive elements arranged on said base; connecting the abrasive elements.

When the abrasive tool is designed and the method is performed and the method is performed in accordance with the present invention, the peeling off of the abrasive elements in the central area of the tool is prevented.

In accordance with another feature of the present invention, the connecting layer in the central area can have a thickness which is greater than its thickness in a remaining area so as to provide an additional stretching ability of the connecting layer in the central area.

In accordance with still another embodiment of the present invention, an additional member can be provided in the central area of the connecting layer so as to enhance axial displacement of the central part of the connecting layer during displacement of the central area of the abrasive tool for conforming to a curved shape of a holder.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 2:
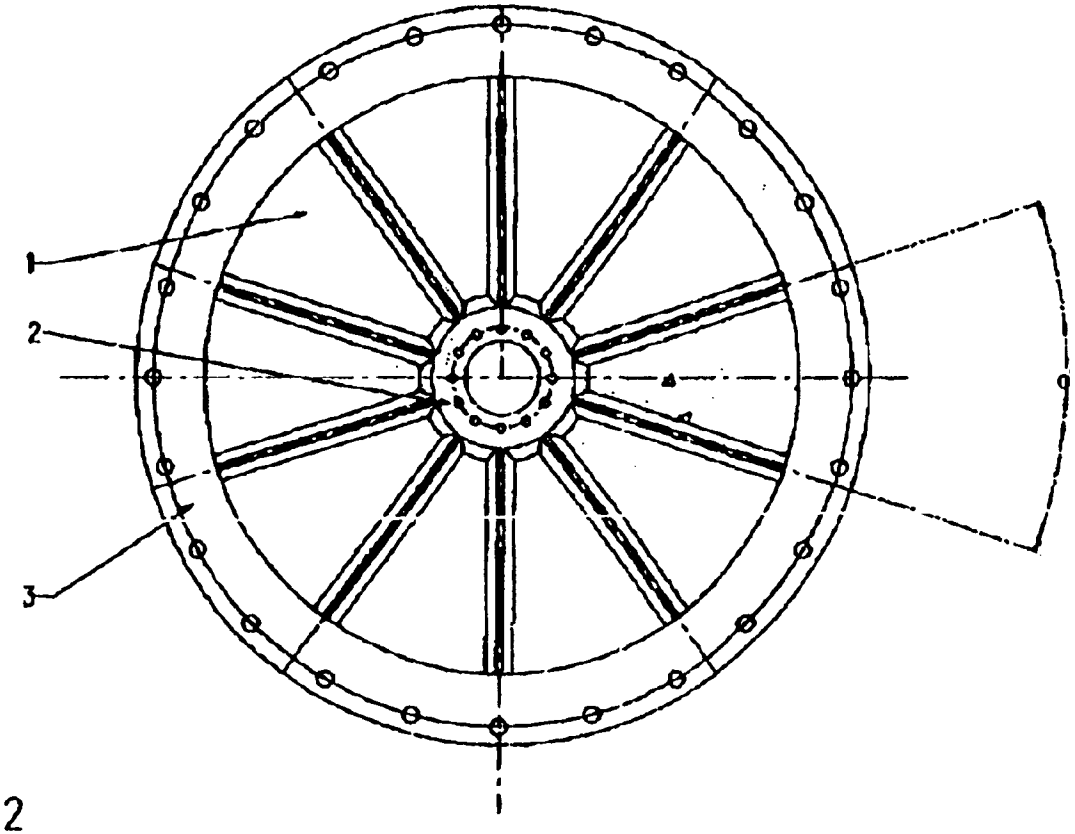
FIG. 2 is a plan view of the abrasive tool shown in FIG. 1.
Figure 1:
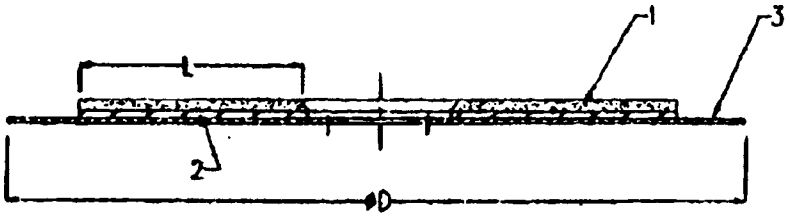
FIG. 1 is a view showing a transverse section of an abrasive tool in accordance with the present invention.

An abrasive tool in accordance with the present invention, for example an abrasive pad for polishing curved surfaces, for instance screens of kinescopes has a base which is identified as a whole with reference numeral 1. The base can be composed of elastomer, for example neoprene rubber or PVC reinforced by polymeric net. The abrasive tool further has a working layer composed of a plurality of individual abrasive elements 2. The abrasive elements 2 are arranged on the base 1 and spaced from one another in a circumferential direction. They can be composed for example of felt, polyurethane, abrasive particles held in a matrix, etc. The abrasive elements 2 are connected with the base 1 by a connecting layer which is identified as a whole with reference numeral 3.

In order to impart to the abrasive tool a curved shape substantially corresponding to a curved shape for example of a kinescopes screen to be abrasively treated, a pin 4 is introduced into a central opening 5 of the tool and displaces the central area of the tool so as to impart to the tool a corresponding curved shape. The connecting layer 3 is composed of an elastic material, for example of nitryl butadiene rubber polyvinyl chloride with elasticity selected so that when the pin 4 displaces the central area of the tool a central area of the connecting layer 3 can stretch, for example radially and axially, and peeling off of the rigid abrasive elements 2 from the base 1 is reliably prevented.

In particular, a central area of the connecting layer 3 which is located between the radially inner edges of the abrasive elements 2 and the central opening 5 is correspondingly elastic to be capable of stretching.

The connecting layer 3 connects the abrasive elements 2 to the base 1 for example by vulcanization at the temperature 310–350° F. and pressure 140–300 psi. While providing reliable connection between the abrasive elements 2 and the base 1, the connecting layer 3 remains sufficiently elastically stretchable. The material of the connecting layer is selected so that it remains sufficiently elastic and stretchable to provide stretching of its central area without peeling off of the abrasive elements 2.

Figure 3:
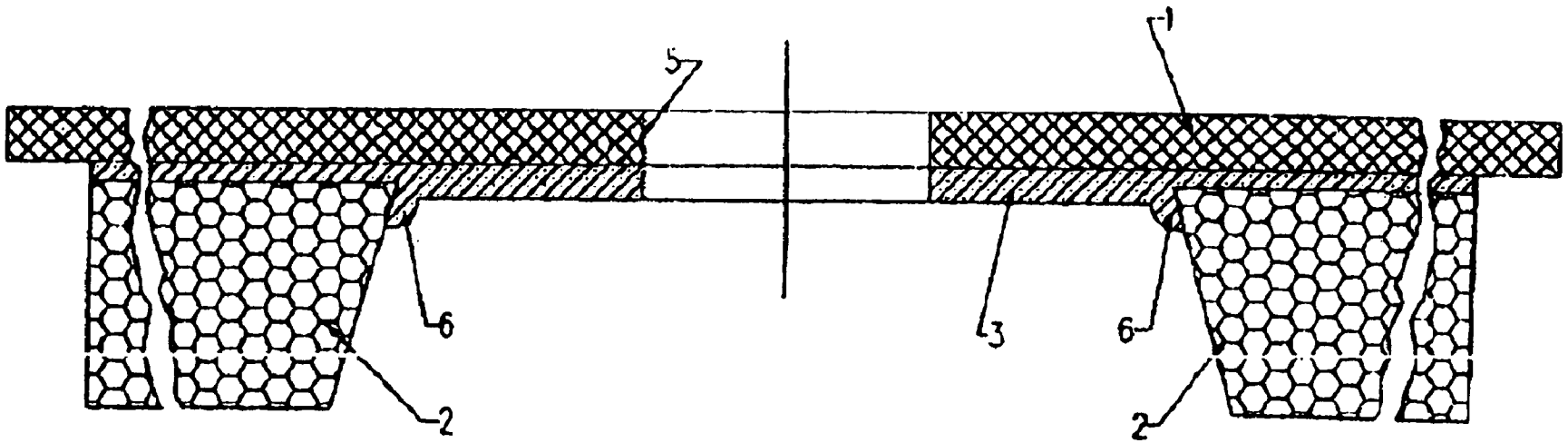
FIGS. 3, 3*a*, 3*b* are views showing a further embodiment of the abrasive tool in accordance with the present invention, in particular a pad, the pad after mounting, the pad after curving.
Figure 3A:
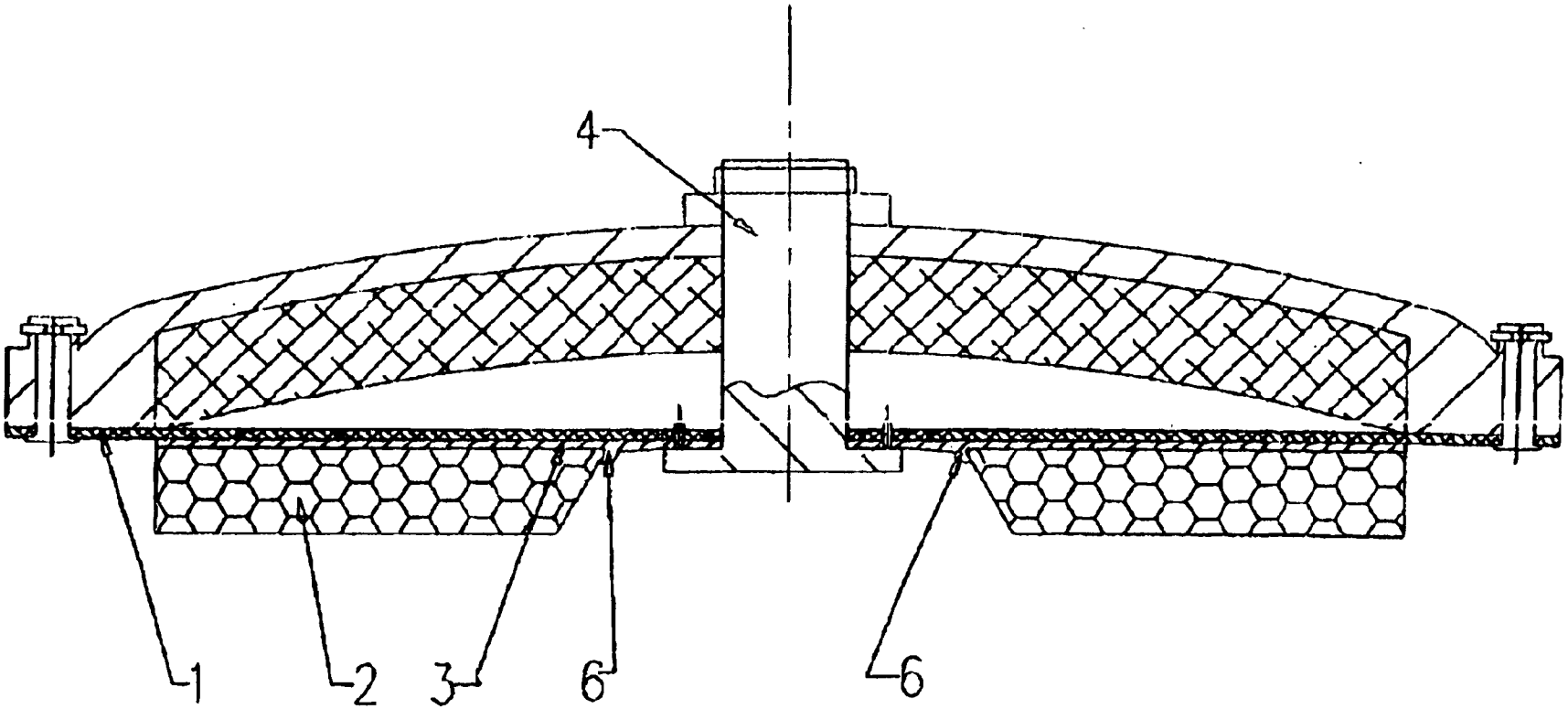
Figure 3B:
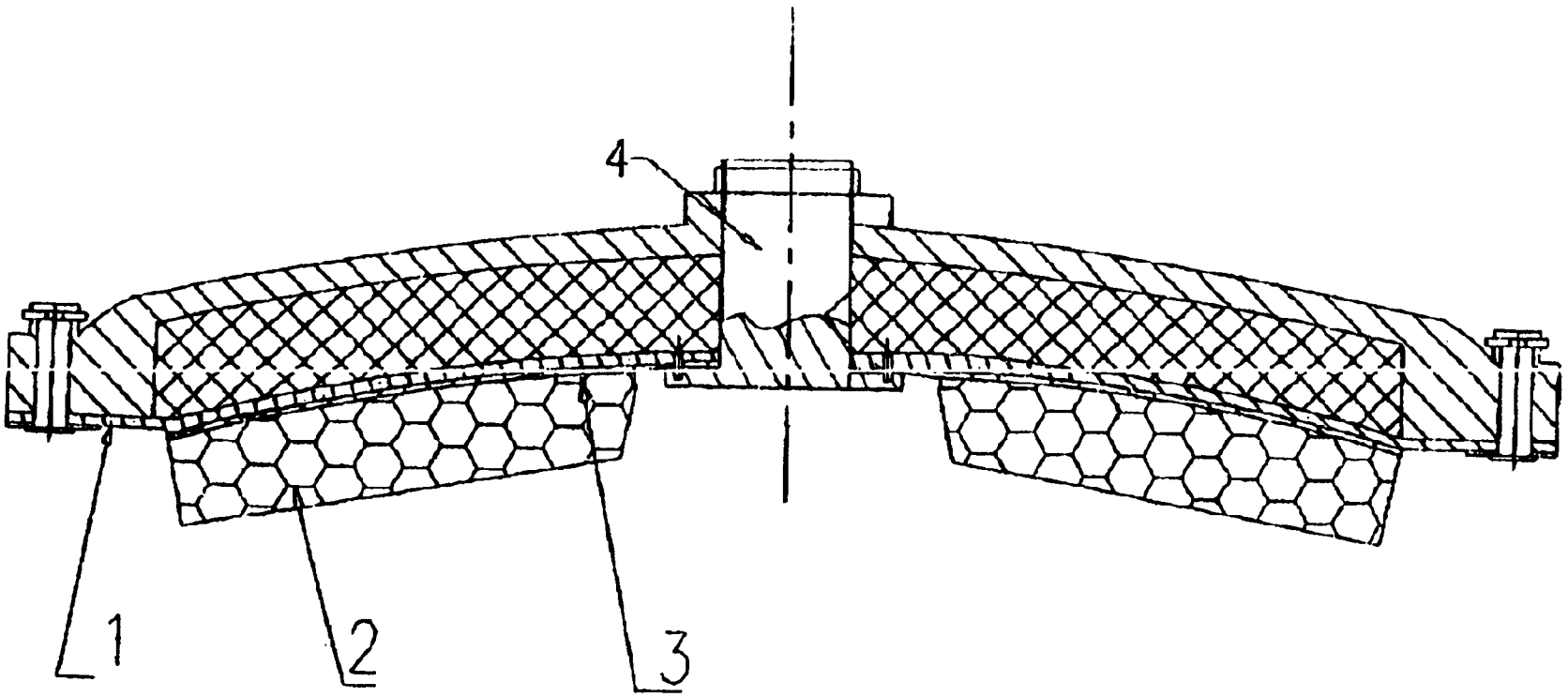

In accordance with another embodiment of the invention shown in FIGS. 3, 3*a*, 3*b*, the central area of the connecting layer 3 can be provided with more material 6 (thickening) than in the remaining area of the connecting layer. In particular, the connecting layer in the central area can have a thickness which is greater than the thickness of the remaining area of the connecting layer. Therefore, an additional reserve of stretching is provided in the central area of the connecting layer 2, to prevent peeling off of the abrasive elements in this area.

Figure 4:
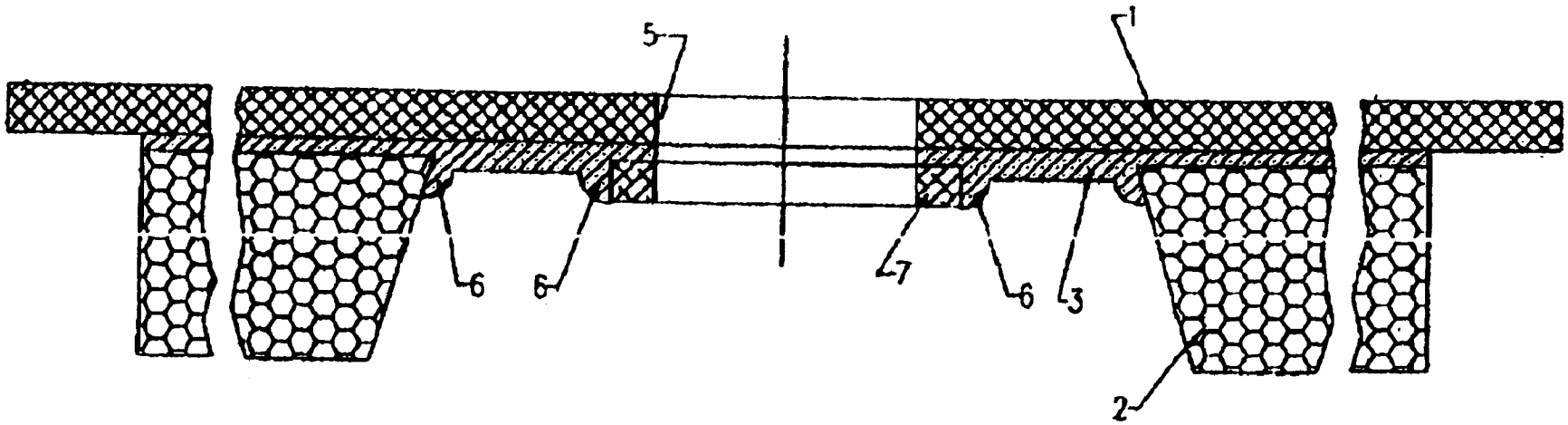
FIGS. 4, 4*a*, 4*b*, are views showing still a further embodiment of the abrasive tool in accordance with the present invention.
Figure 4A:
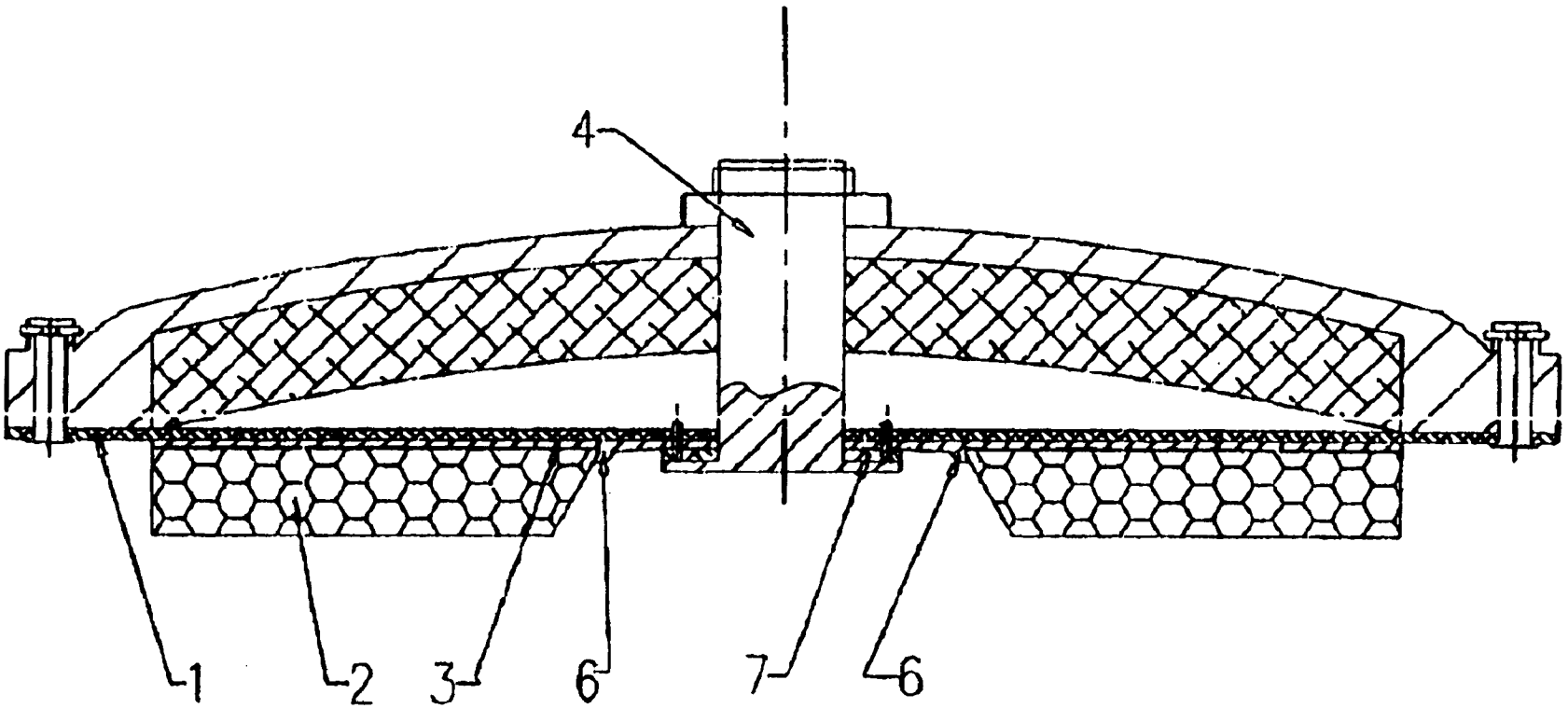
Figure 4B:
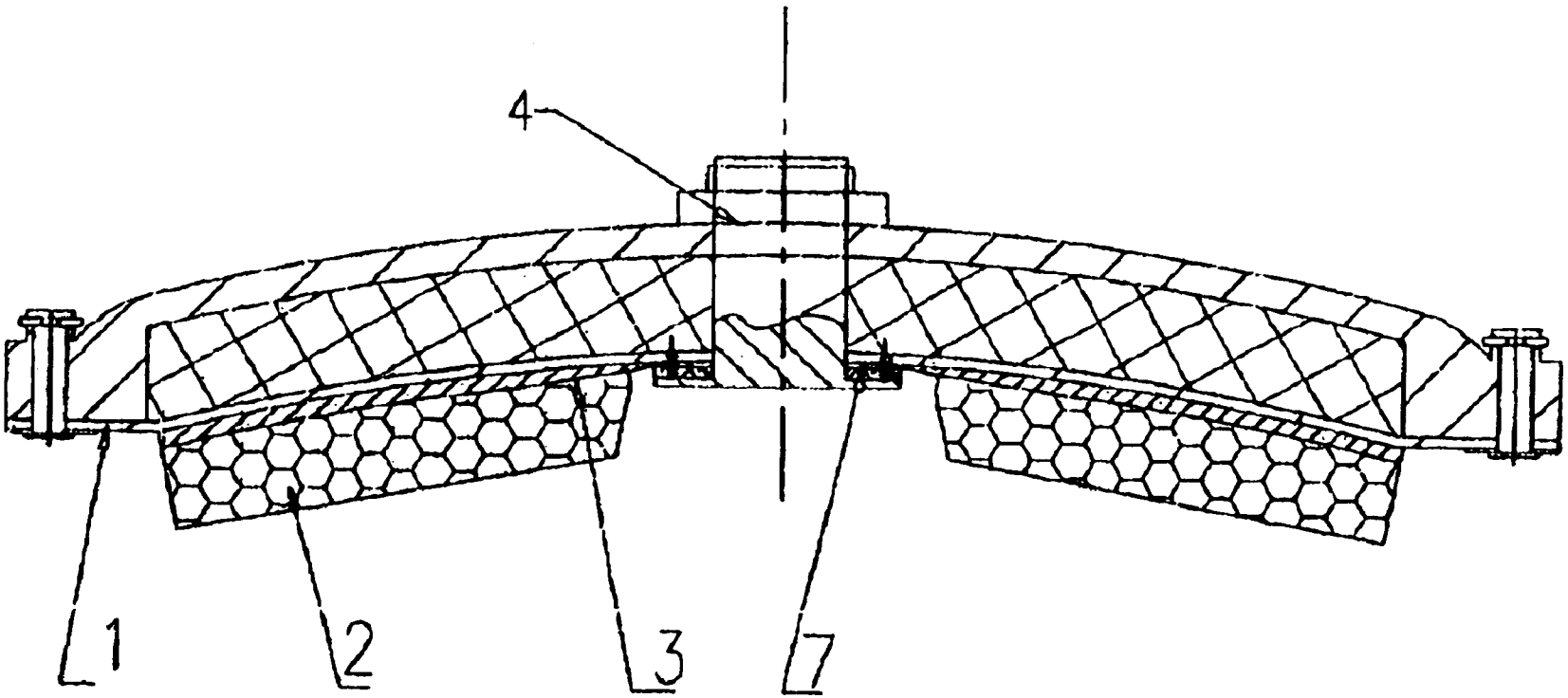

In accordance with still another embodiment of the present invention shown in FIGS. 4, 4*a*, 4*b* an additional member 7 which is harder than the connecting layer 2 is also provided in the central area of the connecting layer. During displacement of the pin 4 and stretching of the connecting layer in the central area, the additional member 7 provides additional pressing of the central area of the connecting element and displacement of the central area, to additionally guarantee that the abrasive elements 2 do not peel off from the base 1.

Figure 5:
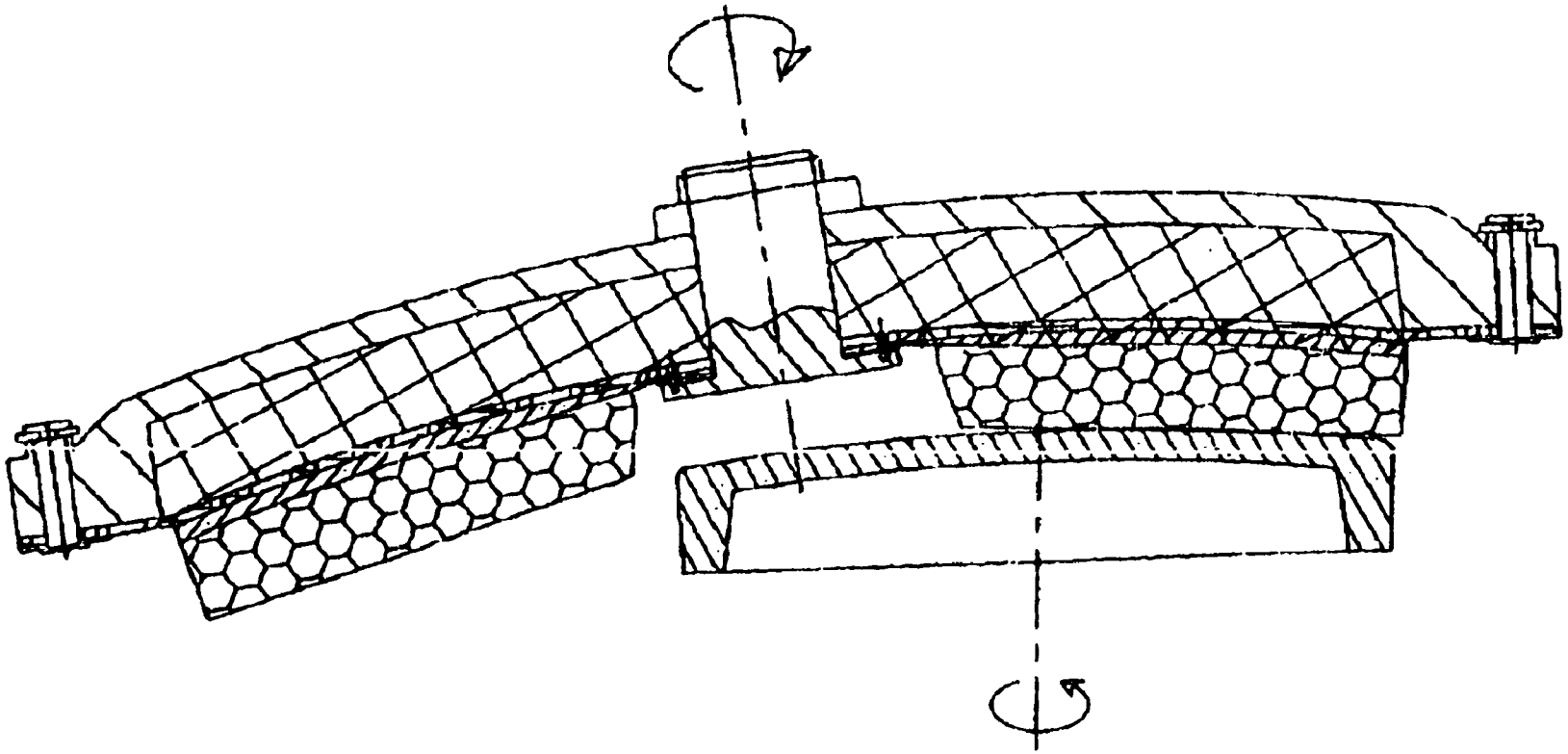
FIG. 5 is a view showing abrasive machining with the inventive abrasive tool.

FIG. 5 shows how the abrasive tool of the present invention is used for abrasive machining.

It will be understood that each of the elements described above, or two or more together, may also find a useful application in other types of constructions and method differing from the types described above.

While the invention has been illustrated and described as embodied in abrasive pad and method of making the same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. An abrasive tool provided for abrasive treatment of curved surfaces and assuming a curved shape during treatment, the abrasive tool comprising a base having an axis; an abrasive means; a connecting layer connecting said abrasive means to said base and having a first surface facing towards said base and being convex during treatment and a second surface facing toward a workpiece to be treated, carrying said abrasive means and being concave during treatment, said connecting layer being composed of an elastic material, said connecting layer in a central area between said abrasive means and near said axis being provided with a thickening having a thickness which is greater than a remaining area of said connecting layer and extending from said second concave surface of said connecting layer toward a workpiece to be treated, so that said abrasive means do not peel off from said base when the abrasive tool is curved.

2. An abrasive tool as defined in claim 1, and further comprising two such thickenings which are radially spaced from one another.

3. An abrasive tool provided for abrasive treatment of curved surfaces and assuming a curved shape during treatment, the abrasive tool comprising a base having an axis; an abrasive means; a connecting layer connecting said abrasive means to said base and having a first surface facing towards said base and being convex during treatment and a second surface facing toward a workpiece to be treated, carrying said abrasive means and being concave during treatment, said connecting layer having a central area located substantially near said axis; and an additional member also located near said central axis so that a part of said connecting layer is located between said additional member and said base, said additional member being located at a side of said second convex surface of said connecting layer and being harder than said central area of said connecting layer, so that when the abrasive tool assumes the curved shape said additional member applies additional pressure to said central area of said connecting layer, so that said abrasive means do not peel off from said base when the abrasive tool is curved.

* * * * *